US005906913A

United States Patent [19]

Marchetti et al.

[11] Patent Number: 5,906,913

[45] Date of Patent: May 25, 1999

[54] NON-UNIFORM IODIDE HIGH CHLORIDE {100} TABULAR GRAIN EMULSION

[75] Inventors: Alfred P. Marchetti; Samuel Chen, both of Penfield; Jeri L. Mount, Rochester, all of N.Y.

[73] Assignee: Eastman Kodak Company, Rochester, N.Y.

[21] Appl. No.: 08/955,277

[22] Filed: Oct. 21, 1997

[51] Int. Cl.[6] ..... G03C 1/035

[52] U.S. Cl. ..... 430/567

[58] Field of Search ..... 430/567, 569

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,806,461 | 2/1989 | Ikeda et al. | 430/567 |
| 5,068,173 | 11/1991 | Takehara et al. | 430/567 |
| 5,275,930 | 1/1994 | Maskasky | 430/567 |
| 5,292,632 | 3/1994 | Maskasky | 430/567 |
| 5,314,798 | 5/1994 | Brust et al. | 430/567 |
| 5,320,938 | 6/1994 | House et al. | 430/567 |
| 5,413,904 | 5/1995 | Chang et al. | 430/569 |
| 5,472,836 | 12/1995 | Haga | 430/567 |
| 5,550,012 | 8/1996 | Suga | 430/567 |
| 5,550,014 | 8/1996 | Maruyama et al. | 430/567 |
| 5,663,041 | 9/1997 | Chang et al. | 430/569 |
| 5,665,530 | 9/1997 | Oyamada et al. | 430/567 |
| 5,807,665 | 9/1998 | Saitou | 430/569 |
| 5,827,639 | 10/1998 | Saitou | 430/567 |

FOREIGN PATENT DOCUMENTS 0 670 515 A2 9/1995 European Pat. Off. ..... G03C 1/015

OTHER PUBLICATIONS

G.C. Farnell, R.B. Flint & J.B. Chanter, "Preferred Sites for Latent–Image Formation", *J. Photogr. Sci.*, 13:25(1965).

J.F. Hamilton, Electron–Microscope Study of Defect Structure and Photolysis in Silver Bromide Microcrystals:, *Photogr. Sci. Eng.*, 11:57(1967).

G.C. Farnell, R.L. Jenkins & L.R. Solman, Grain Disorder and its Influence on Emulsion Response:, *J. Photogr. Sci.*, 24:1(1976).

*Primary Examiner*—Mark F. Huff

*Attorney, Agent, or Firm*—Carl O. Thomas

[57] ABSTRACT

A high chloride {100} tabular grain emulsion is disclosed containing a non-uniform distribution of iodide to increase sensitivity. A high percentage of the {100} tabular grains have one or more crystal lattice dislocations lines at sites of maximum iodide concentration. The dislocation lines are distinctive in that they are oriented parallel to at least one edge of the {100} tabular grains. The mechanism for producing the dislocation lines relies upon a relatively slow rate of addition of iodide ion, improving the reproducibility of emulsion properties in manufacture. Relatively low overall levels of iodide are employed, allowing rapid rates of development.

6 Claims, 1 Drawing Sheet

NON-UNIFORM IODIDE HIGH CHLORIDE {100} TABULAR GRAIN EMULSION

FIELD OF THE INVENTION

The invention relates to radiation-sensitive silver halide emulsions useful in photographic and radiographic imaging.

DEFINITION OF TERMS

In referring to grains and emulsions containing two or more halides, the halides are named in order of ascending concentrations.

The term "high chloride" or "high bromide" in referring to grains and emulsions indicates that chloride or bromide, respectively, is present in a concentration of greater than 50 mole percent, based on total silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "{100} tabular" or "{111} tabular" is employed in referring to tabular grains and tabular grain emulsions to indicate tabular grains having major faces lying in {100} or {111} crystal planes, respectively.

The term "dislocation" refers to a crystal lattice defect that can be observed by microscopic examination of a tabular grain major face.

The term "vAg" indicates the potential difference in volts between a standard reference electrode (Ag/AgCl with 4 molar KCl at room temperature) in a 4 molar KCl salt bridge and an anodized Ag/AgCl indicator electrode.

*Research Disclosure* is published by Kenneth Mason Publications, Ltd., Dudley House, 12 North St., Emsworth, Hampshire P010 7DQ, England.

BACKGROUND

Marked improvements in the performance of photographic emulsions began in the 1980's, resulting from the introduction of tabular grain emulsions into photographic products. A wide range of photographic advantages have been provided by tabular grain emulsions, such as improved speed-granularity relationships, increased covering power (both on an absolute basis and as a function of binder hardening), more rapid developability, increased thermal stability, increased separation of native and spectral sensitization imparted imaging speeds, and improved image sharpness in both mono- and multi-emulsion layer formats.

Although tabular grain emulsions can be selected to provide a variety of performance advantages, depending upon the photographic application to be served, initially commercial interest focused on achieving the highest attainable photographic speeds with minimal attendant granularity. This capability of high bromide (111) tabular grain emulsions was demonstrated by Wilgus et al U.S. Pat. No. 4,434,226 and Kofron et al U.S. Pat. No. 4,439,520. It was, of course, recognized that minor amounts of iodide further improve the speed-granularity relationship, and Solberg et al U.S. Pat. No. 4,433,048 taught that increased iodide concentrations near the peripheral edge of the tabular grains further improved the speed-granularity relationship.

Sometime after silver iodobromide {111} tabular grain emulsions appeared in photographic film products Ikeda et al U.S. Pat. No. 4,806,461 microscopically examined high bromide {111} tabular grains and concluded their superior speed-granularity could be attributed in part to the presence of 10 or more dislocations in tabular grains accounting for at least 50 percent of total grain projected area. This observation was reiterated by Takehara et al U.S. Pat. No. 5,068,173, Haga et al U.S. Pat. No. 5,472,836, Suga et al U.S. Pat. No. 5,550,012, and Maruyama et al U.S. Pat. No. 5,550,014. Before tabular grain emulsions were commercially used and before the observations of Ikeda et al, dislocations had been observed in high bromide {111} tabular grains and postulated to facilitate latent image formation, as illustrated by G. C. Famell, R. B. Flint and J. B. Chanter, "Preferred Sites for Latent-Image Formation", *J. Photogr. Sci.,* 13:25(1965); J. F. Hamilton, "Electron-Microscope Study of Defect Structure and Photolysis in Silver Bromide Microcrystals", *Photogr. Sci. Eng.,* 11:57 (1967); and G. C. Farnell, R. L. Jenkins and L. R. Solman, "Grain Disorder and its Influence on Emulsion Response", *J. Photogr. Sci.,* 24:1(1976).

Black et al U.S. Pat. No. 5,709,988 EMULSIONS EXHIBITING RELATIVELY CONSTANT HIGH discovered that the crystal lattice dislocations in the central region of high bromide {111} tabular grains increase pressure sensitivity while the crystal lattice dislocations in the peripheral region of the tabular grains increase sensitivity without increasing pressure sensitivity.

The first high chloride tabular grain emulsions contained {111} tabular grains, as illustrated by Wey U.S. Pat. No. 4,399,215 and Maskasky U.S. Pat. No. 4,400,463. Maskasky U.S. Pat. Nos. 5,292,632 and 5,275,930 overcame the problem of high chloride {111} tabular grain morphological instability by providing the first high chloride {100} tabular grain emulsions. The combination of the known ecological and developability advantages of high chloride emulsions with the higher tabular shape stability of high chloride grains with {100} crystal faces has stimulated interest in high chloride {100} tabular grain emulsions.

Several forms of incorporation of iodide into high chloride {100} tabular grains have been investigated. House et al U.S. Pat. No. 5,320,938, Chang et al U.S. Pat. No. 5,413,904, and Saito EPO 0 670 515 realized that small amounts of iodide added at or soon after grain nucleation are effective to induce subsequent grain growth in a tabular form.

Brust et al U.S. Pat. No. 5,314,798 observed a speed increase without an offsetting granularity increase when a band of higher iodide content is grown onto a high chloride {100} tabular grain. Brust et al reasoned that it was the non-uniformities of the iodide in the band that were responsible for increased sensitivities. Therefore, Brust et al taught the abrupt (commonly referred to as "dump" ) addition of iodide during band formation. Chang et al U.S. Pat. No. 5,663,041 is cumulative with Brust et al.

PROBLEM TO BE SOLVED

Implementation of the Brust et al teachings in the manufacture of high chloride {100} tabular grain emulsions has confirmed speed enhancement without corresponding increase in granularity, but has revealed disadvantages as well.

The abrupt addition of iodide results in highly localized elevated iodide concentrations in the reaction vessel. The result can be seen on microscopic examination of a grain population in the form of wholly or partially "exploded" grains. These are primarily tabular grains that have broken into a group of smaller grains (often still lying within the external boundary of the initially present tabular grain) or tabular grains that appear to have had a bite taken out of them, where they have come into contact with a destructively elevated local iodide concentration.

Because iodide is added abruptly to maximize iodide induced non-uniformities in the {100} high chloride grains, batch-to-batch variances in emulsion properties have been observed. This have been attributed to inadvertent and difficult to eliminate variances in the rapid addition of iodide.

SUMMARY OF THE INVENTION

It has been discovered quite unexpectedly that the advantages of increased sensitivity in high chloride {100} tabular grain emulsions can be realized while avoiding the disadvantages noted above. Specifically, it has been observed that replacing dump iodide addition as taught by Brust et al with a slower rate of iodide addition preserves the increased sensitivities observed by Brust et al while minimizing batch-to-batch variations in emulsion characteristics and allowing limited levels of iodide incorporation consistent with rapid rates of photographic (including radiographic) processing.

Using transmission electron microscopy, it has been observed quite unexpectedly that the high chloride {100} tabular grain emulsions of the invention exhibit a unique grain structure never previously realized in the art.

In one aspect this invention is directed to a radiation-sensitive emulsion comprised of a dispersing medium and silver halide grains containing greater than 50 mole percent chloride and at least 0.2 mole percent iodide, based on silver, including a sensitivity enhancing non-uniform distribution of iodide, tabular grains having {100} major faces accounting for greater than 50 percent of total grain projected area, wherein (a) iodide within the silver halide grains is limited to less than 0.75 mole percent iodide, based on total silver, (b) at least 80 percent of the tabular grains having {100} major faces contain at least one crystal lattice dislocation line oriented parallel to an edge of a {100} major face, and (c) a higher iodide concentration is present along the dislocation line than at any remaining grain region.

Figure 1:
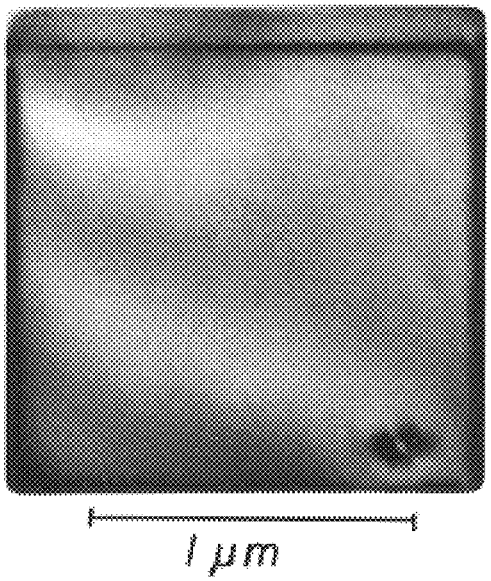
FIGS. 1 and 2 are transmission electron micrographs of representative high chloride {100} tabular grains from emulsions prepared according to this invention.

The grain in FIG. 1 has one edge parallel crystal lattice dislocation line.

Figure 2:
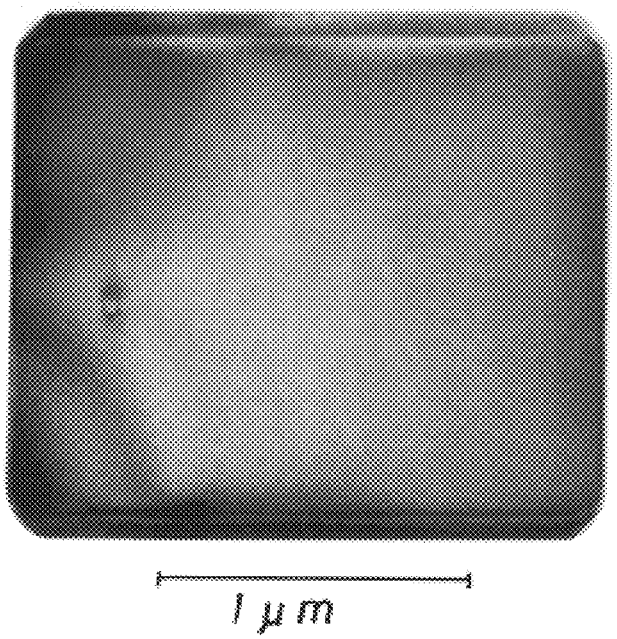

The grain in FIG. 2 has two edge parallel crystal lattice dislocation lines.

DESCRIPTION OF PREFERRED EMBODIMENTS

The emulsions of the invention can be prepared by the following procedure:

In the first step, step (1), a high chloride {100} tabular grain emulsion is prepared by any convenient conventional process of preparation, with the exception that, if the conventional procedure includes the formation of a higher iodide peripheral band as taught by Brust et al, cited above, band formation is omitted. That is, a conventional preparation is undertaken up to band formation. The majority of high chloride {100} tabular grain emulsion preparations known to the art include no step of forming an increased iodide concentration band and can therefore be followed without modification to complete step (1).

Examples of starting emulsions and their preparation are provided by the following patents (hereinafter referred to as the starting emulsion patents), the disclosures of which are here incorporated by reference:

| | |
|---|---|
| Maskasky | U.S. Pat. No. 5,292,632; |
| House et al | U.S. Pat. No. 5,320,938; |
| Saitou et al | U.S. Pat. No. 5,652,089; |
| Maskasky | U.S. Pat. No. 5,264,337; |
| Brennecke | U.S. Pat. No. 5,498,518; |
| Chang et al | U.S. Pat. No. 5,413,904; |
| Brust et al* | U.S. Pat. No. 5,314,798; |
| Olm et al | U.S. Pat. No. 5,457,021; |
| Oyamada | U.S. Pat. No. 5,593,821; |
| Oikawa | U.S. Pat. No. 5,654,133; |
| Saitou et al | U.S. Pat. No. 5,587,281; |
| Yamashita | U.S. Pat. No. 5,565,315; |
| Yamashita et al | U.S. Pat. No. 5,641,620; |
| Yamashita et al | U.S. Pat. No. 5,652,088; and |
| Chang et al* | U.S. Pat. No. 5,633,041. |

(*band formation to be omitted)

By definition the starting high chloride {100} tabular grain emulsions (a) contain greater than 50 mole percent chloride, based on silver and (b) have greater than 50 percent of total grain projected area accounted for by tabular grains having an aspect ratio of at least 2.

The starting emulsions preferably contain greater than 70 mole percent chloride, based on silver, and optimally greater than 90 mole percent chloride, based on silver. The remaining halide, if any, can be bromide and/or iodide. It is preferred to limit iodide concentrations to less than 10 (most preferably less than 5) mole percent, based on silver. When iodide is employed at or near grain nucleation solely for inducing tabular grain growth, amounts of iodide as low as 0.001 (preferably 0.01) mole percent iodide have been shown to be sufficient to provide {100} tabular grains. Contemplated silver grain compositions include silver chloride, silver iodochloride, silver bromochloride, silver iodobromochloride and silver bromoiodochloride.

The tabular grains preferably account at least 70 percent of total grain projected area and optimally at least 90 percent of total grain projected area. The tabular grains preferably have an average aspect ratio of at least 5 and most preferably greater than 8. The tabular grains preferably have an average thickness of less than 0.3 $\mu$m and most preferably less than 0.2 $\mu$m. Ultrathin tabular grain emulsions, those in which the tabular grains have an average thickness of less than 0.07 $\mu$m, are specifically contemplated.

It is generally preferred to choose starting high chloride {100} tabular grain emulsions having the highest conveniently realized proportion of the total high chloride grain population accounted for by {100} tabular grains while also having the lowest conveniently realized average thickness of the tabular grains.

The average aspect ratio of the {100} tabular grains is limited by the average grain ECD desired in the emulsion prepared from the starting emulsion. With minimum amounts of silver addition in the formation of crystal lattice dislocations, the starting emulsion can have a mean grain ECD that is not significantly different from that of the product emulsion. The maximum increase in mean grain ECD in the product emulsion occurs when, following the addition of a soluble iodide salt, a maximum amount of silver is introduced and grain growth occurs entirely or nearly entirely at the edges of the tabular gains. In this case the percent increase in average grain projected area (PA) is the same as the percent additional silver added. Using the formula:

$$PA=\pi(ECD)\div 2)^2 \quad \text{(I)}$$

the degree to which the mean grain ECD in the starting emulsion must be reduced below the desired mean grain ECD in the product emulsion can be calculated.

In the second step, step (2), of emulsion preparation, iodide ion in the form of a soluble salt, such as alkali or alkaline earth iodide, is introduced into the starting emulsion without the further addition of silver or other halide salts. The iodide ion introduced displaces chloride ion from the edges of the starting high chloride {100} tabular grains, thereby achieving a halide conversion displacement. Contrary to the addition of iodide during double jet precipitation taught by Brust et al, which is dependent upon rapid iodide addition to produce crystal lattice disruptions, the halide conversion produced by iodide addition while withholding the addition of silver is effective when undertaken slowly. Hence iodide addition can occur over a period of minutes rather than instantaneously or over a period of seconds, as contemplated by Brust et al for abrupt iodide addition. The ability to employ slower iodide addition rates facilitates a higher degree of reproducibility and therefore minimizes batch-to-batch variations in the process. It also eliminates the problem of wholly or partially exploded tabular grains. To insure that the halide conversion has gone to completion, the emulsion is held briefly, usually a few minutes, before proceeding to the next step of the preparation process.

The amount of iodide introduced as a soluble salt in step (2) is chosen to create a maximum iodide concentration in the portion of the grain at which the edge parallel crystal dislocation line appears in the next step of the preparation process. The emulsions of the invention contain at least 0.2 mole percent iodide, based on total silver, but less than 0.75 mole percent iodide, based on total silver. It is preferred that iodide addition to the grains be confined to step (2), except when comparatively negligible amounts of iodide are employed to create tabular grain growth at or near grain nucleation, as described by House et al U.S. Pat. No. 5,292,632 and Chang et al U.S. Pat. No. 5,413,904, cited and incorporated by reference above. It is, of course, possible to introduce iodide during step (1) and in the grain growth step subsequent to step (2), provided sufficient iodide is introduced in step (2) to create a maximum iodide concentration at the edge parallel crystal lattice dislocation line or lines that become overservable during and following subsequent grain growth.

In step (3) the introduction of silver salt and halide salt containing greater than 50 mole percent chloride, based on silver, is undertaken. Grain growth conditions are selected for the growth step from among those known in producing conventional high chloride {100} tabular grain emulsions. That is, the grain growth in step (3) can take any of the conventional forms illustrated by the patents cited and incorporated by reference in the description of step (1). Viewed another way, the high chloride {100} tabular grain preparations disclosed in the patents cited and incorporated by reference in connection with step (1) can be viewed as being interrupted in the growth step to accommodate step (2) described above.

As a result of the iodide incorporation in step (2) and further silver and halide salt precipitation in step (3), grain growth occurs on the peripheral edges of the {100} tabular grains while introducing into at least 80 percent of the high chloride {100} tabular grains at least one crystal lattice dislocation (observed by transmission electron microscopy as a line) that is oriented parallel to an edge of the tabular grain and its {100} major face. A significant, but smaller portion of the {100} tabular grains also exhibit a second edge parallel crystal lattice dislocation. When two edge parallel crystal lattice dislocations are present, they are observed on either two opposite or two adjacent edges. A very few {100} tabular grains exhibit a third edge parallel crystal lattice dislocation, with the peripheral region along only one edge lacking an edge parallel dislocation.

It is possible to achieve the desired level of crystal lattice dislocations at the peripheral edges of the high chloride {100} tabular grains with very low amounts of additional grain growth. Silver additions during step (3) amounting to at least 0.5 (preferably at least 1.0) percent of silver in the starting (host) grains are contemplated. Large silver additions amounting to 30 percent or more of the silver in the starting emulsion are possible, but it is preferred to limit additional silver addition in step (3) to 20 (optimally 10) percent or less of total silver.

The product high chloride {100} tabular grain emulsions can have mean ECD's in any conventional range. Typically mean ECD's of 5.0 $\mu$m or less are preferred. The average aspect ratios, tabular grain thicknesses, and tabular grain projected areas are within the ranges described above in connection with the starting high chloride {100} tabular grain emulsions. Halide compositions are similar to those of the starting tabular grain emulsions, except for the iodide ion incorporated in step (2), rendering iodide an essential rather than an optional halide inclusion. Since silver iodide is much less soluble than other silver halides, all of the iodide added in step (2) is incorporated into the grains.

In the starting emulsion patents cited and incorporated by reference above as illustrative of step (1) starting high chloride {100} tabular grain emulsions, it is appreciated that bands or shells of higher iodide and/or bromide content are sometimes present. Step (2) of the present invention can occur prior to or after band or shell formation. When band or shell formation has previously occurred in step (1), an adjustment of the reaction vessel at the start of step (3) may be necessary to reestablish conditions favorable for high chloride {100} tabular grain growth that existed at an earlier stage of grain growth in the step (1) precipitation.

Once formed, the high chloride {100} tabular grain emulsions can be sensitized, combined with conventional photographic addenda, and coated in any conventional manner, as is further illustrated by the starting emulsion patents cited and incorporated by reference above.

Generally preparing the emulsions for use following precipitation begins with emulsion washing. This is in turn followed by chemical and spectral sensitization. Antifoggant and stabilizer addition is usually also undertaken. The emulsions are also combined with additional levels of vehicle before coating. Hardener is added to one or more vehicle layers just before coating. The emulsions are contemplated for use in both black-and-white (silver image forming) and color (dye image forming) photographic elements. The emulsions can be incorporated in radiographic and black-and-white photographic elements. The emulsions can also be incorporated in color print, color negative or color reversal elements. The following paragraphs of *Research Disclosure,* Vol. 389, September 1996, Item 38957, illustrate conventional photographic features compatible with the emulsions of the invention:

I. Emulsion grains and their preparation E. Blends, layers and performance categories II. Vehicles, vehicle extenders, vehicle-like addenda and vehicle related addenda III. Emulsion washing IV. Chemical sensitization V. Spectral sensitization and desensitization VII. Antifoggants and stabilizers IX. Coating physical property modifying addenda X. Dye image formers and modifiers XI. Layer arrangements XV. Supports XVIII. Chemical development systems

EXAMPLES

The invention can be better appreciated by reference to the following specific examples. "D. W." indicates distilled water.

All of the emulsions reported below exhibited mean grain ECD's of 1.4 μm and mean tabular grain thicknesses of 0.11 μm. The high chloride {100} tabular grains accounted for greater than 80 percent of total grain projected area.

Example 1 (a Comparative Example)

In this comparative example, the preparation of high chloride {100} tabular grain emulsions was undertaken employing rapid ("dump") addition of iodide step (2), as taught by Brust et al U.S. Pat. No. 5,314,798. These emulsions were comparative dump iodide emulsion (CDIE) differing their dump iodide content.

Emulsion CDIE—1

Seven solutions were prepared as follows:

| Solution A1 | | | |
|---|---|---|---|
| Gelatin (oxidized) | | 37.5 | gm |
| antifoamant | | 0.86 | mL |
| NaCl | | 3.15 | gm |
| D.W. | | 4238 | gm |
| **Solution B1** | | | |
| NaCl | | 447.5 | gm |
| D.W. | | 1754 | gm |
| **Solution C1** | | | |
| $AgNO_3$ | (5.722M) | 2181.6 | gm |
| HgCl2 | | 0.56 | mg |
| D.W. | | 479.5 | gm |
| **Solution D1** | | | |
| NaCl | | 3.3 | gm |
| KI | | 0.6 | gm |
| D.W. | | 9.431 | Kg |
| **Solution E1** | | | |
| KI | | 1.06 | gm |
| D.W. | | 74.58 | gm |
| **Solution F1** | | | |
| Gelatin (phthalated) | | 180 | gm |
| D.W. | | 1000 | mL |

-continued

| Solution G1 | | |
|---|---|---|
| Gelatin (bone) | 167 | gm |
| D.W. | 1500 | mL |

Solution A1 was charged into a reaction vessel equipped with a stirrer. The temperature was raised to 45° C. While vigorously stirring the reaction vessel, Solutions B1 and C1 were added at a rate of 45 mL/min for 0.57 minutes maintaining a vAg of 154 mV. Solution D1 was then added to the mixture and held for 8 minutes. Following this hold, Solutions B1 and C1 were added at a rate of 15 mL/min for 5 minutes maintaining the vAg at 160 mV. For the next 15 minutes, while maintaining a constant flow rate of 15 mL/min, the vAg was decreased from 160 mV to 150 mV and the temperature was increased from 45° C. to 50° C. Following these adjustments, Solutions B1 and C1 were added simultaneously at a linearly accelerated rate from 15 ml/min to 42.6 mL/min in 39 minutes with the vAg maintained at 150 mV. The mixture was held for 15 minutes. Following this hold, Solution E1 was delivered at once by manually dumping it into the reaction vessel in less than 5 seconds. The mixture was then held for 20 minutes. Maintaining the same vAg, Solutions B1 and C1 were added at a rate of 15 mL/min for 10 minutes. The mixture was then cooled to 40° C. Solution F1 was added and stirred for 5 minutes. The pH was adjusted to 3.8 and the gel allowed to settle. The liquid layer was decanted and the depleted volume was restored with distilled water. The mixture was held until the temperature returned to 40° C. The pH was then adjusted to 4.2 and the mixture stirred for 5 minutes before the pH was adjusted to 3.8 and the settling and decanting steps repeated. Solution G1 was added and the pH and pC1 adjusted to 5.7 and 1.6 (vAg=130 mV) respectively.

Emulsion CDIE-2

This emulsion was prepared identically as Emulsion CDIE-1, except that solution E-1 was replaced with solution E-2:

| Solution E2 | | |
|---|---|---|
| KI | 2.12 | gm |
| D.W. | 74.28 | gm |

Emulsion CDIE-3

This emulsion was prepared identically as Emulsion CDIE-1, except that solution E1 was replaced with solution E3:

| Solution E3 | | |
|---|---|---|
| KI | 3.36 | gm |
| D.W. | 73.94 | gm |

Emulsion CDIE-4

This emulsion was prepared identically as Emulsion CDIE-1, except that solution E1 was replaced with solution E4:

| Solution E4 | |
|---|---|
| KI | 5.62 gm |
| D.W. | 73.31 gm |

Emulsion CDIE-5

This emulsion was prepared identically as Emulsion CDIE-1, except that solution E1 was replaced with solution E2:

| Solution E5 | |
|---|---|
| KI | 8.40 gm |
| D.W. | 72.54 gm |

Emulsion CDIE-6

This emulsion was prepared identically as Emulsion CDIE-1, except that solution E1 was replaced with solution E6:

| Solution E6 | |
|---|---|
| KI | 11.20 gm |
| D.W. | 74.28 gm |

Grain Examination

Examination of the {100} tabular grains by transmission electron microscopy revealed three major categories:

0 Those having no observable edge parallel crystal lattice dislocatlon;
1 Those having one observable edge parallel crystal lattice dislocation; and
2 Those having two observable edge parallel crystal lattice dislocations.

A typical category 1 tabular grain is shown in FIG. 1. A typical category 2 tabular grain emulsion is shown in FIG. 2. The FIG. 1 and 2 grains were both taken from invention emulsion ERIE-6, described below, but are representative of category 1 and 2 grains in each of the emulsions.

In some instances a very small proportion of the {100} tabular grains contained three edge parallel crystal lattice dislocations.

The emulsions are listed in Table I to show the correlation between overall iodide concentrations, based on total silver, and the 0, 1 and 2 category {100} tabular grains.

TABLE I

| | | Grain Defect Category (%) | |
|---|---|---|---|
| Emulsion | M % I | 0 | 1 + 2 = |
| CDIE-1 | 0.1 | 98.4 | 0.5 + 0.5 = 1.0 |
| CDIE-2 | 0.2 | 99.0 | 0.5 + — = 0.5 |
| CDIE-3 | 0.3 | 89.2 | 9.6 + 0.3 = 9.9 |
| CDIE-4 | 0.5 | 57.7 | 40.1 + 2.2 = 42.3 |
| CDIE-5 | 0.75 | 14.1 | 54.5 + 31.1 = 85.6 |
| CDIE-6 | 1.0 | 5.7 | 63.0 + 31.3 = 94.3 |

From Table I it is apparent that, when a rapid (dump) addition of iodide was undertaken in emulsion precipitation, the overall iodide concentration of at least 0.75 mole percent, based on total silver, was required before 80 percent of the {100} tabular grains were observed to contain one or more edge parallel crystal lattice dislocations.

This indicated that high chloride {100} tabular grain emulsions containing less than 0.75 mole percent iodide, based on total silver, could not be prepared using conventional dump iodide addition techniques to obtain a high proportion of tabular grains having edge parallel crystal lattice dislocations.

Example 2 (a Comparative Example)

Emulsion CRIE-1 (a comparative emulsion) was prepared employing the same solutions as Emulsion CDIE-1, except that Solution E7 was substituted for Solution E1:

| Solution E7 | |
|---|---|
| KI | 1.06 gm |
| NaCl | 21.04 gm |
| D.W. | 442.45 gm |

The following procedure for precipitation was employed, which differed from the procedure of CRIE-1 in that iodide was run into the dispersing medium rather than being added abruptly by dump addition:

Solution A1 was charged into a reaction vessel equipped with a stirrer. The temperature was raised to 45° C. While vigorously stirring the reaction vessel, Solutions B1 and C1 were added at a rate of 45 ml/min for 0.57 minutes maintaining a vAg of 154 mV. Solution D1 was then added to the mixture and held for 8 minutes. Following this hold, Solutions B1 and C1 were added at a rate of 15 mL/min for 5 minutes maintaining the vAg at 160 mV. For the next 15 minutes, while maintaining a constant flow rate of 15 mL/min, the vAg was decreased from 160 mV to 150 mV and the temperature was increased from 45° C. to 50° C. Following these adjustments, Solutions B1 and C1 were added simultaneously at a linearly accelerated rate from 15 mL/min to 42.6 mL/min in 39 minutes with the vAg maintained at 150 mV. The mixture was held for 15 minutes. Following this hold, Solution E7 was added at a rate of 45 mL/min for 10 minutes. The mixture was held for an additional 5 minutes. Maintaining the same vAg, Solutions B1 and C1 were added at a rate of 15 mL/min for 10 minutes. The mixture was then cooled to 40° C. Solution F1 was added and stirred for 5 minutes. The pH was adjusted to 3.8 and the gel allowed to settle. The liquid layer was decanted and the depleted volume was restored with distilled water. The mixture was held until the temperature returned to 40° C. The pH was then adjusted to 4.2 and the mixture stirred for 5 minutes before the pH was adjusted to 3.8 and the settling and decanting steps repeated. Solution G1 was added and the pH and pCl adjusted to 5.7 and 1.6 (vAg=130 mV) respectively.

The limited amount of iodide added to the emulsion was insufficient to create a edge parallel crystal lattice dislocations in a high proportion of the high chloride {100} tabular grains, as shown in Table II below.

Example 3 (a Demonstration of the Invention)

Emulsion ERIE-2

Emulsion ERIE-2 (an invention emulsion) was prepared by the same procedure as Emulsion CRIE-1, except that Solution E8 was substituted for Solution E7:

| Solution E8 | | |
|---|---|---|
| KI | 2.12 | gm |
| NaCl | 21.04 | gm |
| D.W. | 442.15 | gm |

Doubling the amount of iodide added to the emulsion, compared to CRIE-1, produced a 3.5 times increase in the proportion of the high chloride {100} tabular grains exhibiting at least one edge parallel crystal lattice dislocation. The results are summarized in Table II below.

Emulsion ERIE-3

Emulsion ERIE-3 (an invention emulsion) was prepared by the same procedure as Emulsion CRIE-1, except that Solution E9 was substituted for Solution E7:

| Solution E9 | | |
|---|---|---|
| KI | 3.36 | gm |
| NaCl | 21.04 | gm |
| D.W. | 441.20 | gm |

The amount of iodide added to the emulsion was increased 50 percent, as compared ERIE-2. An increase in the proportion of the high chloride {100} tabular grains exhibiting at least one edge parallel crystal lattice dislocation was observed. The results are summarized in Table II below.

Emulsion ERIE-4

Emulsion ERIE-4 (an invention emulsion) was prepared by the same procedure as Emulsion CRIE-1, except that Solution E10 was substituted for Solution E7:

| Solution E10 | | |
|---|---|---|
| KI | 5.60 | gm |
| NaCl | 21.04 | gm |
| D.W. | 441.20 | gm |

The amount of iodide added to the emulsion was increased 2.5 times, as compared ERIE-2. An increase in the proportion of the high chloride {100} tabular grains exhibiting at least one edge parallel crystal lattice dislocation was observed. The results are summarized in Table II below.

TABLE II

| | | Grain Defect Category (%) | |
|---|---|---|---|
| Emulsion | M % I | 0 | 1 + 2 = |
| CRIE-1 | 0.1 | 76.0 | 23.2 + 0.8 = 24.0 |
| ERIE-2 | 0.2 | 11.8 | 61.3 + 21.9 = 83.2 |
| ERIE-3 | 0.3 | 12.1 | 65.8 + 22.1 = 87.9 |
| ERIE-4 | 0.5 | 7.3 | 63.7 + 28.9 = 92.6 |

From Table II it is apparent that between 0.1 and 0.2 M% iodide a threshold was crossed, resulting in a dramatic increase in the proportion of high chloride {100} tabular grains having one or more edge parallel crystal lattice dislocations.

Example 4 (a Further Demonstration of the Invention)

This example discloses emulsions according to the invention prepared by varying vAg at the time of iodide incorporation.

Emulsion ERIE-5

Emulsion ERIE-5 (an invention emulsion) was prepared by the same procedure as Emulsion CRIE-1, except that Solution E11 was substituted for Solution E7:

| Solution E11 | | |
|---|---|---|
| KI | 3.36 | gm |
| D.W. | 448.30 | gm |

Emulsion ERIE-6

Emulsion ERIE-5 (an invention emulsion) was prepared by the same procedure as Emulsion CRIE-1, except that Solution E12 was substituted for Solution E7:

| Solution E12 | | |
|---|---|---|
| KI | 5.6 | gm |
| D.W. | 447.7 | gm |

Emulsion ERIE-7

Emulsion ERIE-7 (an invention emulsion) was prepared by the same procedure as Emulsion CRIE-1, except that Solution E13 was substituted for Solution E7 and the emulsion was held for 5 minutes following E13 addition:

| Solution E13 | | |
|---|---|---|
| KI | 3.36 | gm |
| NaCl | 60.49 | gm |
| D.W. | 428.20 | gm |

Emulsion ERIE-8

Emulsion ERIE-8 (an invention emulsion) was prepared by the same procedure as Emulsion CRIE-1, except that Solution E14 was substituted for Solution E7 and the emulsion was held for 5 minutes following E14 addition:

| Solution E14 | | |
|---|---|---|
| KI | 5.60 | gm |
| NaCl | 60.49 | gm |
| D.W. | 427.53 | gm |

Emulsion ERIE-9

Emulsion ERIE-9 (an invention emulsion) was prepared employing the same solutions as Emulsion CDIE-1, except that Solutions B2 and E15 were substituted for Solutions E1 and B1, respectively:

| Solution B2 | | |
|---|---|---|
| NaCl | 478.27 | gm |
| D.W. | 1874.8 | gm |
| **Solution B15** | | |
| KI | 5.6 | gm |
| D.W. | 446.12 | gm |

The following procedure for precipitation was employed:

Solution A1 was charged into a reaction vessel equipped with a stirrer. The temperature was raised to 45° C. While vigorously stirring the reaction vessel, Solutions B2 and C1 were added at a rate of 45 mL/min for 0.57 minutes while maintaining a vAg of 154 mV. Solution D1 was added to the mixture and held for 8 minutes. Following this hold, Solutions B2 and C1 were added at a rate of 15 mL/min for 5 minutes, maintaining the vAg at 160 mV. For the next 15 minutes, while maintaining a constant flow rate of 15 mL/min, the vAg was decreased from 160 mV to 150 mV and the temperature was increased from 45° C. to 50° C. Following these adjustments, Solutions B2 and C1 were added simultaneously at a linearly accelerated rate from 15 mL/min to 42.6 mL/min in 39 minutes with the vAg maintained at 150 mV. The mixture was held for 15 minutes. Following this hold, Solution B2 was added at a rate of 18 mL/min, ending when the vAg of the reaction vessel equaled 130 mV. The mixure was held for 1 minute. Following this hold, Solution E15 was added at a rate of 45 mL/min for 10 minutes. The mixture was held for an additional 10 minutes. Maintaining the same vAg, Solutions B2 and C1 were added at a rate of 15 mL/min for 10 minutes. The mixture was then cooled to 40° C. Solution F1 was added and stirred for 5 minutes. The pH was adjusted to 3.8 and the gel allowed to settle. The liquid layer was decanted and the depleted volume was restored with distilled water. The mixture was held until the temperature returned to 40° C. The pH was then adjusted to 4.2 and the mixture stirred for 5 minutes before the pH was adjusted to 3.8 and the settling and decanting steps repeated. Solution G1 was added and the pH and pCl adjusted to 5.7 and 1.6 (vAg=130 mV) respectively.

The results are summarized in Table III.

TABLE III

| | | Grain Defect Category (%) | |
|---|---|---|---|
| Emulsion | M % I | 0 | 1 + 2 = |
| ERIE-5 | 0.3 | 11.8 | 60.9 + 26.3 = 87.2 |
| ERIE-6 | 0.5 | 11.7 | 56.7 + 31.7 = 88.4 |
| ERIE-7 | 0.3 | 11.3 | 67.1 + 21.6 = 88.7 |
| ERIE-8 | 0.5 | 8.0 | 62.9 + 28.6 = 91.5 |
| ERIE-9 | 0.5 | 14.7 | 57.8 + 27.1 = 84.9 |

From Table III it is apparent that varied vAg adjustments during iodide incorporation are possible while producing emulsions satisfying the requirements of the invention.

Example 5

This example compares the sensitivity of representative invention emulsions and comparison dump iodide emulsions.

The emulsions were spectrally sensitized by addition of a 6:1 molar ratio of Dye-SS1, anhydro-5-chloro-9-ethyl-5'-phenyl-3'-(3-sulfobutyl)-3-(3-sulfopropyl)oxacarbocyanine hydroxide, sodium salt, and Dye-SS2, anhydro-3,9-diethyl-3'-methylsulfonylcarbamoylmethyl-5-phenyloxathiocarbocyanine hydroxide, followed by a 20 minute hold at 40° C. The emulsions were then chemically sensitized using N,N'-dicarboxymethyl-N,N'-dimethylthiourea at 3.4 mg/Ag mole and $Au^{+1}$triazolium thiolate at 2.0 mg/Ag mole followed by heating for 10 minutes at 60° C. Following heating, 1-(3-acetamidophenyl)-5-mercaptotetrazole was added in the amount of 100 mg/Ag mole.

Following finishing as described above, the emulsions were each coated onto a transparent film support at 10.76 mg Ag/dm$^2$ (100 mg Ag/ft$^2$) with the added cyan dye-forming coupler C-1 coated at 9.68 mg/dm$^2$ (90 mg/ft$^2$).

(C-1)

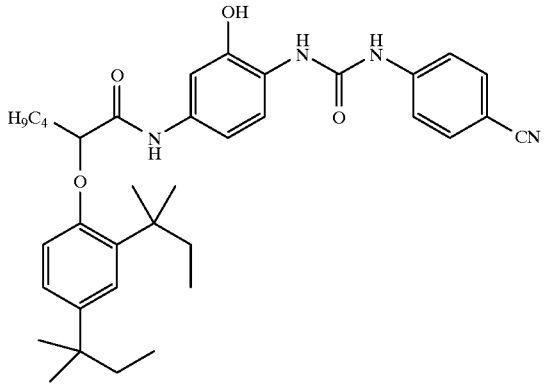

A protective gelatin layer containing hardener was coated over each emulsion layer.

The resulting elements were each given a stepped exposure for 1/50 second using a Daylight V light source passed through a Wratten™ W-9. The elements were processed in 135 seconds in a Kodak Flexicolor™ C-41 color negative process.

Fog (Dmin) was measured. Photographic speeds were measured at a density of Dmin+0.15. Speeds are reported as relative log speeds, where each unit difference in speed corresponds to 0.01 log E, where E is exposure in lux-seconds.

The sensitometric comparisons are summarized in Table IV.

TABLE IV

| Emulsion | M % I | Rel. Speed | Dmin |
|---|---|---|---|
| CDIE-3 | 0.3 | 276 | 0.17 |
| ERIE-3 | 0.3 | 276 | 0.18 |
| ERIE-5 | 0.3 | 276 | 0.19 |
| ERIE-7 | 0.3 | 276 | 0.12 |
| CDIE-4 | 0.5 | 278 | 0.10 |
| ERIE-4 | 0.5 | 275 | 0.10 |
| ERIE-6 | 0.5 | 275 | 0.12 |
| ERIE-8 | 0.5 | 282 | 0.12 |

From Table IV it is apparent that the art recognized enhanced sensitometric performance of the conventional dump iodide emulsions (the CDIE emulsions) can be matched with the emulsions of the invention (the ERIE emulsions). Thus, the known preparation inconvenience and batch-to-batch variability of dump iodide emulsion preparations can be avoided while still achieving the outstanding sensitivities of dump iodide emulsions.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and silver halide grains containing greater than 50 mole percent chloride and at least 0.2 mole percent iodide, based on silver, including a sensitivity enhancing non-uniform distribution of iodide, tabular grains having {100} major faces accounting for greater than 50 percent of total grain projected area,

WHEREIN (a) iodide within the silver halide grains is limited to less than 0.75 mole percent iodide, based on total silver, (b) at least 80 percent of the tabular grains having {100} major faces contain at least one crystal lattice dislocation line oriented parallel to an edge of a {100} major face, and (c) a higher iodide concentration is present along the dislocation line than at any remaining grain region.

2. A radiation-sensitive emulsion according to claim 1 wherein the tabular grains have an average aspect ratio of greater than 8.

3. A radiation-sensitive emulsion according to claim 1 wherein the tabular grains have an average thickness of less than 0.2 $\mu$m.

4. A radiation-sensitive emulsion according to claim 1 wherein the tabular grains account for greater than 70 percent of total grain projected area.

5. A radiation-sensitive emulsion according to claim 1 wherein the silver halide grains contain less than 0.7 mole percent iodide, based on silver.

6. A radiation-sensitive emulsion according to claim 1 wherein the silver halide grains are silver iodochloride grains.

* * * * *